US008869784B2

(12) United States Patent
LoRocco et al.

(10) Patent No.: US 8,869,784 B2
(45) Date of Patent: Oct. 28, 2014

(54) ILLUMINATED SIGHTING DEVICE WITH REMOVABLE OPTICAL FIBERS

(75) Inventors: Paul LoRocco, Dallas, TX (US); John Estridge, Plano, TX (US); Damon Coalson, Dallas, TX (US); Greg Webb, Garland, TX (US)

(73) Assignee: TruGlo, Inc., Richardson, TX (US)

( * ) Notice: Subject to any disclaimer, the term of this patent is extended or adjusted under 35 U.S.C. 154(b) by 0 days.

(21) Appl. No.: 13/531,801

(22) Filed: Jun. 25, 2012

(65) Prior Publication Data

US 2012/0325194 A1 Dec. 27, 2012

Related U.S. Application Data

(60) Provisional application No. 61/500,997, filed on Jun. 24, 2011.

(51) Int. Cl.
*F41G 1/467* (2006.01)

(52) U.S. Cl.
CPC ..... *F41G 1/467* (2013.01)
USPC ..... 124/87

(58) Field of Classification Search
USPC ..... 124/87; 42/111, 113, 120, 134, 141
See application file for complete search history.

(56) References Cited

U.S. PATENT DOCUMENTS

| | | | | |
|---|---|---|---|---|
| 4,591,885 | A * | 5/1986 | Day et al. | 347/125 |
| 4,657,397 | A * | 4/1987 | Oehler et al. | 356/414 |
| 5,184,013 | A * | 2/1993 | Boutet et al. | 250/236 |
| 5,653,034 | A * | 8/1997 | Bindon | 42/131 |
| 5,924,234 | A | 7/1999 | Bindon et al. | |
| 6,634,111 | B2 * | 10/2003 | LoRocco | 33/265 |
| 6,807,742 | B2 | 10/2004 | Schick et al. | |
| 6,817,105 | B2 * | 11/2004 | LoRocco | 33/265 |
| 7,308,891 | B2 * | 12/2007 | Graf | 124/87 |
| 2008/0174868 | A1 * | 7/2008 | Schuck et al. | 359/487 |

* cited by examiner

*Primary Examiner* — Gene Kim
*Assistant Examiner* — Amir Klayman
(74) *Attorney, Agent, or Firm* — Alvin R. Wirthlin

(57) ABSTRACT

An illuminated sighting device for an archery bow includes a bracket member for mounting to an archery bow, a frame portion with a sight window adapted for connection to the bracket member, and a first set of optical fibers connected to the plurality of sight pins. Each optical fiber has a distal end forming an illuminated sight dot coincident with its respective sight pin. A plurality of elongate light collectors, in the form of a second set of fluorescent-doped optical fibers, are optically coupled to the first set of optical fibers via a retaining member that is removably connected to one of the bracket member, frame portion and sight pins such that one or more of the light collectors can be removed and replaced independently of the first set of optical fibers.

7 Claims, 12 Drawing Sheets

ILLUMINATED SIGHTING DEVICE WITH REMOVABLE OPTICAL FIBERS

CROSS REFERENCE TO RELATED APPLICATIONS

This application claims the benefit of U.S. Provisional Application No. 61/500,997 filed on Jun. 24, 2011, the disclosure of which is hereby incorporated by reference.

BACKGROUND OF THE INVENTION

This invention relates generally to sighting devices for firearms, archery bows, or other projectile launching devices, and more particularly to a self-illuminated sighting device having a removable light collector, such as a fluorescent-doped optical fiber.

Sighting devices using short segments of light gathering optical fibers to form aiming points at different distances from the target are currently in use. Such optical fibers are typically fluorescent-doped with a color and thus have the capability of gathering ambient light along their length and transmitting that light to their ends. Under ideal lighting conditions, one end of the optical fiber typically serves as a bright aiming point with the brightness being directly dependent on the level of ambient light incident on the length of optical fiber. When the optical fibers become damaged or broken for various reasons, it is often difficult to replace such fibers, especially in the field when timing is critical to the hunt.

In addition, it is often difficult to change the color of a specific aiming point without replacing the entire pin assembly. Typically, replacing a damaged fiber or changing the color of a fiber requires replacement of the entire pin assembly, which results in the need to "sight in" the new sight pin assembly.

BRIEF SUMMARY OF THE INVENTION

In accordance with one aspect of the invention, an illuminated sight assembly includes a sight pin, at least one first optical fiber operably associated with the sight pin, at least one light collector, and a retaining member. The first optical fiber has a distal end that forms an illuminated sight dot and a proximal end spaced from the distal end. The at least one light collector has a distal end optically coupled to the proximal end of the at least one first optical fiber. The retaining member is operably associated with the light collector for removably connecting the distal end of the light collector to the proximal end of the first optical fiber such that the light collector can be removed and installed independently of the first optical fiber.

In accordance with a further aspect of the invention, an illuminated sighting device for an archery bow includes a bracket member for mounting to an archery bow, a frame portion adapted for connection to the bracket member, the frame portion forming a sight window, a plurality of sight pins extending into the sight window, a plurality of first optical fibers connected to the plurality of sight pins, each first optical fiber having a distal end forming an illuminated sight dot coincident with its respective sight pin, a plurality of elongate light collectors, each elongate light collector having a distal end optically coupled to a proximal end of an associated first optical fiber, and a retaining member removably connected to the frame portion. The retaining member includes a plurality of bores extending therethrough for receiving a proximal end of the first optical fibers. Each bore has a reduced diameter portion for receiving the distal end of the light collector to thereby optically couple the first optical fiber and light collector together. The distal end of the light collector extends through the reduced diameter portion and has an integrally formed lens located forwardly of the reduced diameter portion with a cross dimension that is larger than a cross dimension of the reduced diameter portion to thereby removably retain the light collectors within the retaining members. In this manner, the light collectors can be removed independently of the first optical fibers.

In accordance with another aspect of the invention, an illuminated sighting device for an archery bow includes a bracket member for mounting to an archery bow, a frame portion adapted for connection to the bracket member, the frame portion forming a sight window, a plurality of sight pins extending into the sight window, a plurality of first optical fibers connected to the plurality of sight pins, each first optical fiber having a distal end forming an illuminated sight dot coincident with its respective sight pin, a plurality of elongate light collectors, each elongate light collector having a distal end optically coupled to a proximal end of an associated first optical fiber, and a retaining member removably connected to one of the bracket member, frame portion and sight pins, for removably connecting the distal end of each light collector to the proximal end of an associated first optical fiber such that one or more of the light collectors can be removed and replaced independently of its associated first optical fiber.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein:

FIG. 22 is a right rear isometric view of an illuminated sight assembly in accordance with a further embodiment of the present invention for connection to a sight bracket of FIG. 1 or the like;

It is noted that the drawings are intended to depict typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
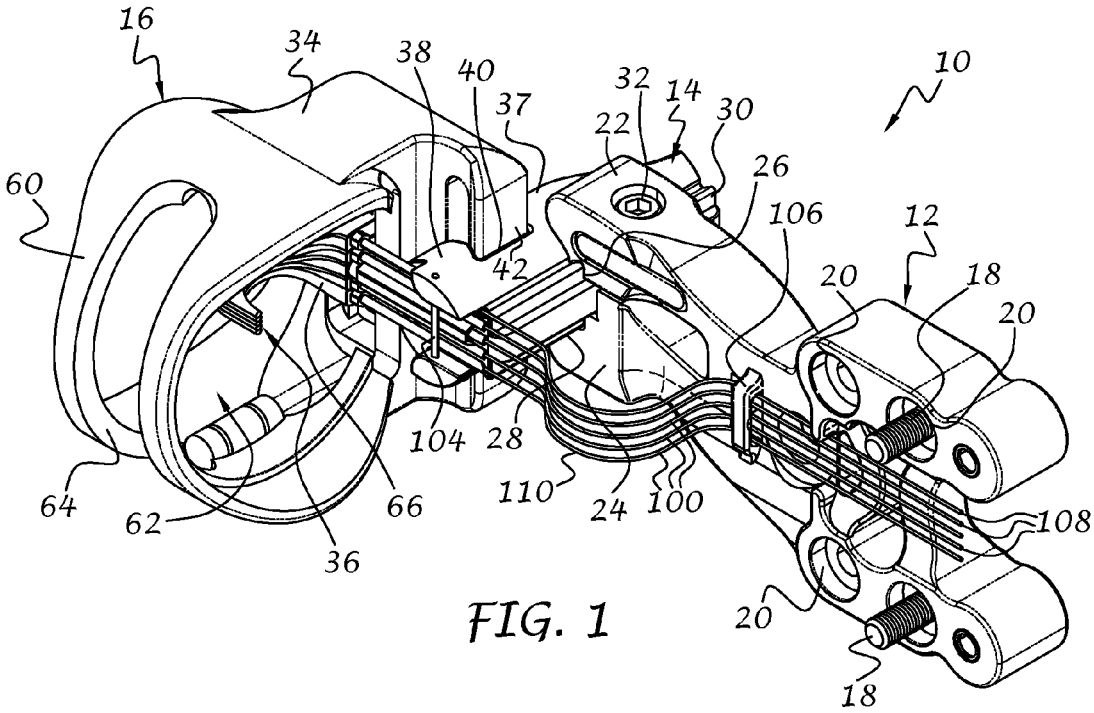
FIG. 1 is a left rear isometric view of an illuminated sighting device in accordance with an exemplary embodiment of the present invention.
Figure 2:
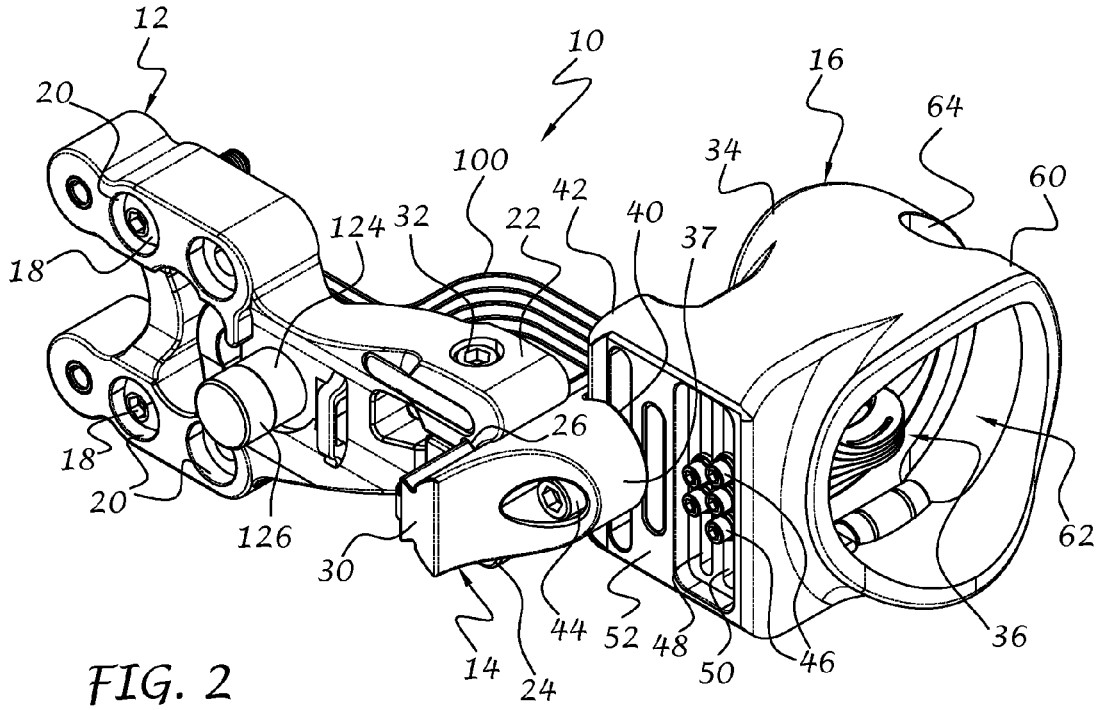
FIG. 2 is a right front isometric view thereof.

Referring to the drawings, and to FIGS. 1 and 2 in particular, a sighting device 10 in accordance with the present invention is illustrated. The sighting device 10 as shown is embodied as a bow sight. To this end, the sighting device 10 preferably includes a bracket member 12, an adjustment base 14 connected to the bracket member 12, and a sight assembly 16 connected to the adjustment base 14. The bracket member 12 is useful for attaching the sighting device to an archery bow (not shown) or the like via fasteners 18 that extend through openings 20 in the bracket member 12 and into the bow structure (not shown) in a conventional manner. However, it will be understood that the sighting device 10 may be adapted for use with any projectile launching device such as a rifle, pellet gun, BB gun, pistol, paint marker, and the like, and can be used with other devices, such as telescopes, sighting scopes, and so on, in order to quickly align the device with a distal target or scene.

The bracket member 12 preferably includes an upper jaw portion 22 and a lower jaw portion 24 with dovetail-like grooves 26 and 28, respectively that are shaped to receive a complementary dovetail-like projection 30 of the adjustment base 14. A bolt 32 extends through an opening in the upper jaw portion 22 and into a threaded opening of the lower jaw portion 24. Preferably, rotation of the bolt 32 in a clockwise direction draws the jaws 22, 24 toward each other to clamp around the base 14 at a desired position with respect to the bracket member 12 while rotation of the bolt in a counter-clockwise direction causes the jaws to move away from each other for adjusting the linear position of the base 14 with respect to the bracket member 12. Although not shown, a windage scale can be provided on the adjustment base 14 for displaying the relative position between the bracket member 12 and base 14. By way of example, it may be necessary to adjust the lateral position of the sight assembly 16 during windy conditions and/or when calibrating the sighting device 10 for use with a particular bow, arrow and/or other device or projectile.

The sight assembly 16 preferably includes a frame portion 34 connected to the adjustment base 14 and a sight portion 36 connected to the frame portion 34. The adjustment base 14 preferably includes an outer jaw portion 37 and an inner jaw portion 38 with a dovetail-like slot 40 formed therebetween that is shaped to receive a complementary dovetail-like projection 42 of the frame portion 34. A bolt 44 (FIG. 2) extends through an opening in the outer jaw portion 37 and into a threaded opening of the inner jaw portion 38. Preferably, rotation of the bolt 44 in a clockwise direction draws the jaws 37 and 38 toward each other to clamp around the dovetail 42 so that the sight assembly 16 is vertically adjusted to a desired position with respect to the base 14. Conversely, rotation of the bolt in a counter-clockwise direction causes the jaws to move away from each other for adjusting the vertical position of the sight assembly 16 with respect to the base 14 and thus the bracket member 12. Although not shown, a height scale can be provided on the frame portion 34 for displaying the relative position between the sight assembly 16 and the adjustment base 14. Vertical adjustment of the entire sight assembly 16 may be needed when initially calibrating the sighting device 10 with a particular bow or other device, when changing from one arrow type to another, when shooting from different heights, such as from the ground or a tree stand, and so on.

Figure 3:
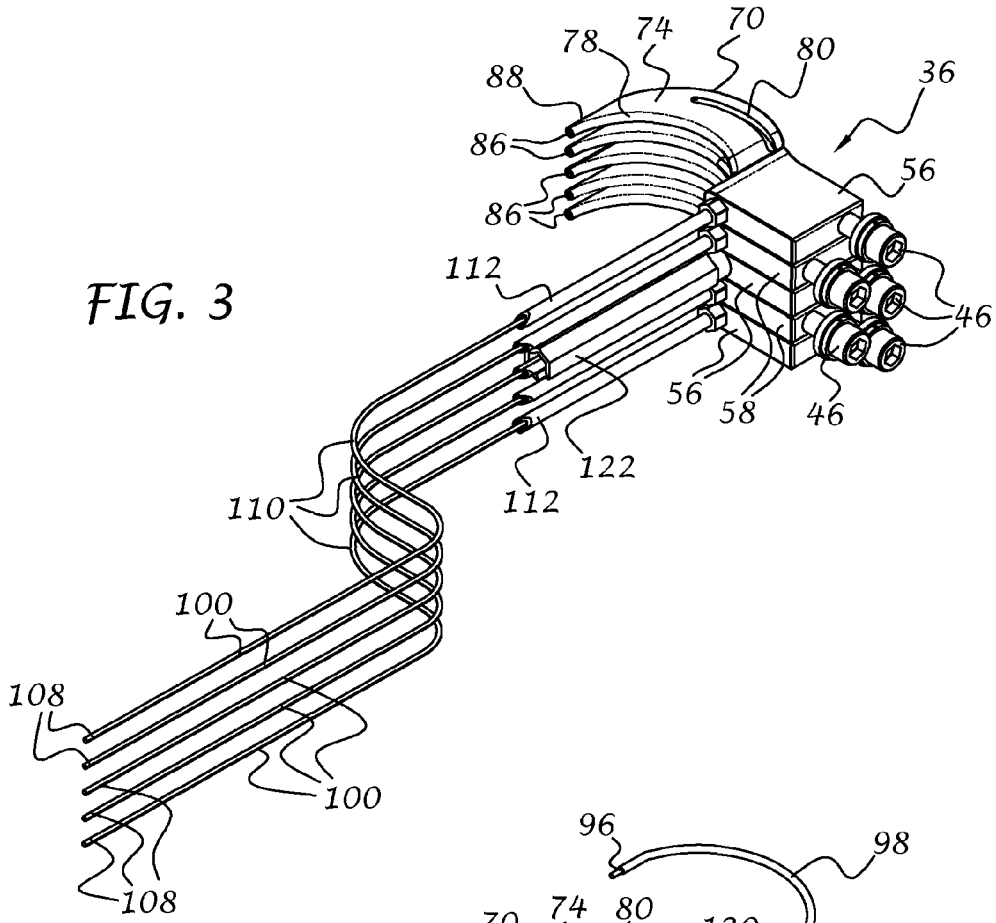
FIG. 3 is a right rear isometric view of an illuminated sight assembly with a plurality of pin assemblies in accordance with the present invention that forms part of the sighting device of FIG. 1.

The sight portion 36 preferably includes one or more sight pin assemblies 56, 58 connected to the frame portion 34 with bolts 46 (FIG. 2) that extend through vertically extending slots 48, 50 formed in a side wall 52 of the frame portion 34 and into threaded openings 54 (FIG. 4) of each alternating pin assembly 56, 58 (FIG. 3). In this manner, each pin assembly 56, 58 is independently adjustable in a vertical direction to accommodate a particular bow strength and arrow type for different yardages or distances to a target.

The frame portion 34 preferably has an annular wall 60 that forms a sight window 62 through which the sight assembly 16 and a distal target can be viewed. Preferably, the sight assembly 16 is mounted to the sight frame within the sight window 62. An elongate, curved opening 64 can be provided in the annular wall 60 to reduce the weight of the sighting device 10 and provide more light for the sight assembly 16.

Referring now to FIGS. 3-7, the sight pin assemblies 56, 58 are vertically oriented to demark different target distances. For example, the top pin assembly 56 can be used to demark a target at 25 yards, the next pin assembly 58 can be used to demark a target at 50 yards, and so on. Although five separate pin assemblies 56, 68 are shown, it will be understood that more or less pin assemblies may be provided. Since the pin assemblies 56, 58 are identical in construction with the exception of the location of the threaded opening 54, only the pin assembly 56 will be described in greater detail.

The sight pin assembly 56 preferably includes a main body portion 66 with the threaded opening 54 formed in one side 68 thereof and a sight pin portion 70 extending from the opposite side 72 thereof. The pin portion 70 preferably includes an upper surface 74, a lower surface 76 and a side surface 78 that extends between the upper and lower surfaces. A continuous arcuate slot or groove includes a first arcuate slot or groove 80 formed in the upper surface 74 and a second arcuate slot or groove 82 and a third arcuate slot or groove 84 are formed in the lower surface 76. Preferably, the first arcuate slot 80 is located between the second and third arcuate slots. An opening 86 is formed at a convergent tip 88 of the pin portion 70 and intersects with the third slot 84. A threaded bore 90 extends into the main body portion 66 and intersects with the second slot 82.

A first optical fiber 92 is preferably located within the pin portion 70 and is coincident with the arcuate slots 80, 82 and 84. A proximal end 94 of the optical fiber 92 is located in the bore 90 while a distal end 96 is located in the opening 86. The optical fiber 92 preferably comprises a plastic optical fiber with a transparent core material and a suitable cladding material having a lower refractive index than the core material to ensure that a substantial amount of radiant energy entering the proximal end 94 will exit the distal end 96. However, it will be understood that any suitable material can be used for the optical fiber without departing from the spirit and scope of the invention. A protective sheath 98 can be provided over a portion of the optical fiber 92, especially the portion that is exposed through the arcuate slots, to protect the optical fiber from environmental contaminants. The distal end 96 of the optical fiber serves as an illuminated sight point or dot during aiming. If desired, one or both ends of the first optical fiber 92 can be formed with a lens.

A light collector 100, or second optical fiber, has a distal end 102 that extends into the bore 90 for optical connection with the proximal end 94 of the first optical fiber 92. The light collector 100 is preferably constructed of a fluorescent-doped optical fiber or the like. A suitable fluorescent-doped optical fiber may be constructed of a polystyrene-based core containing one or more fluorescent dopants that is surrounded by a polystyrene, polymethyl methacrylate, or fluoropolymer cladding. When such an optical fiber receives radiation along its length, energy is absorbed in the optical fiber at a certain wavelength and is re-emitted at both ends of the optical fiber at a longer wavelength. Thus, depending on the amount of radiation absorbed by the optical fiber along its length, a proportionate amount of radiation is emitted at the ends of the optical fiber.

Although the optical fiber is preferably circular in cross section, it is contemplated that other cross sectional shapes such as oval, triangular, rectangular, arcuate, etc., may be used. Moreover, it will be understood that the light collector 100 is not limited to the particular material as set forth in the exemplary embodiment. The core and cladding may be formed out of any suitable transparent or translucent materials, as long as the index of refraction of the core material is greater than the index of refraction of the cladding material. The cladding material itself may be air or other fluid surrounding at least a portion of the core material. Accordingly, it will be understood that the light collector may be in the form of a molded piece of plastic with or without a fluorescent dopant. It will be further understood that the length, diameter or thickness and the amount of dopant within the core of the light collector 100 can vary and depends on the desired brightness of the sight point as viewed by the user under varying ambient conditions.

As shown in FIG. 1, each light collector 100 preferably includes a single length of fluorescent-doped optical fiber that extends from each main body portion 66, through a first or front guide 104 associated with the adjustment base 14 and a second or rear guide 106 associated with the bracket member 12. The outer free ends 108 of the light collectors 100 preferably extend rearwardly from the bracket member 12. A loop or extra length of light collector is provided to accommodate adjustment between the bracket member 12, adjustment base 14, and sight assembly 16.

Figure 4:
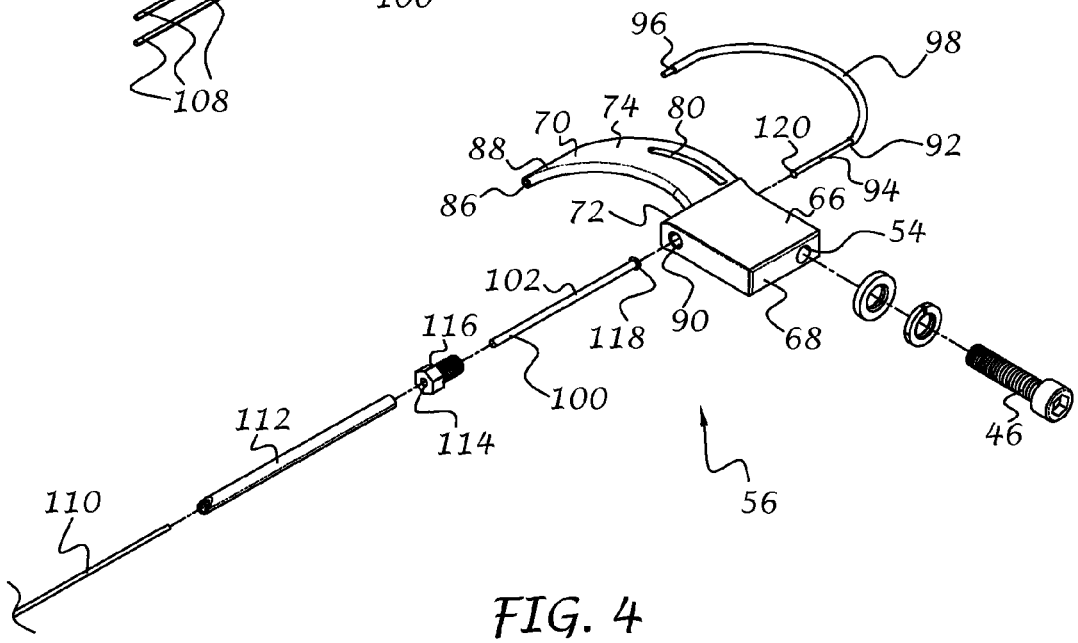
FIG. 4 is a right rear isometric exploded view of one of the pin assemblies of FIG. 3.
Figure 5:
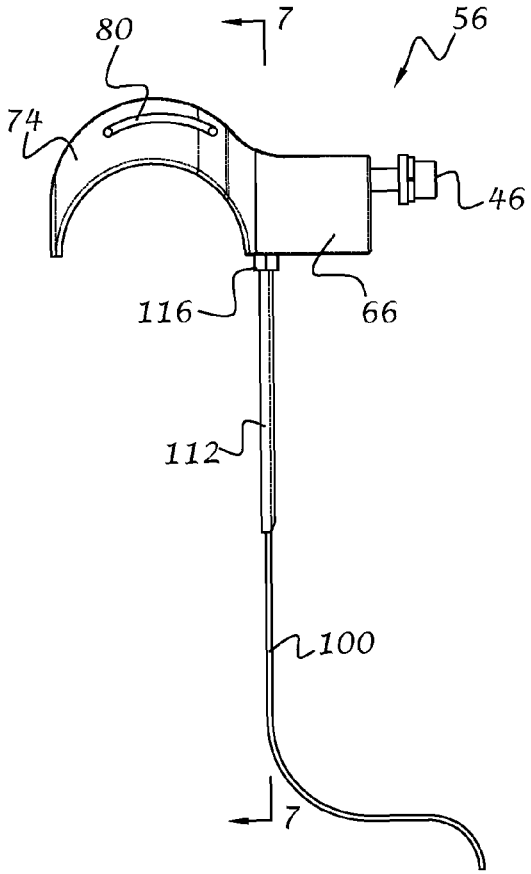
FIG. 5 is a top plan view thereof.
Figure 6:
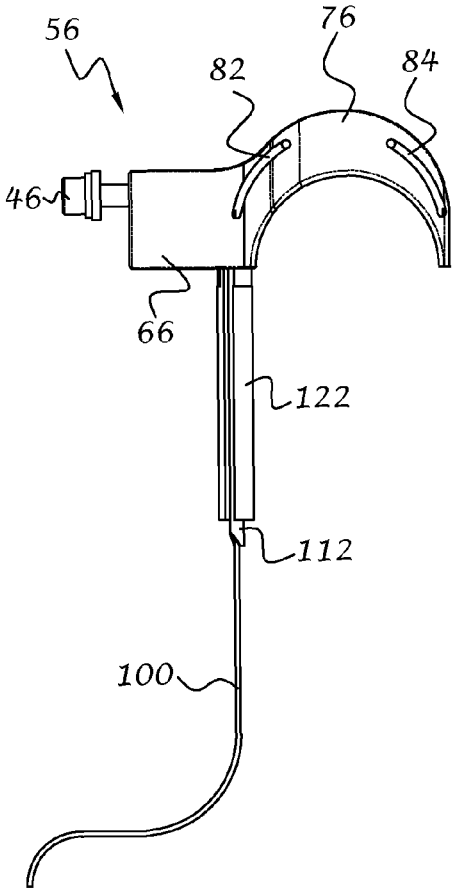
FIG. 6 is a bottom plan view thereof.
Figure 7:
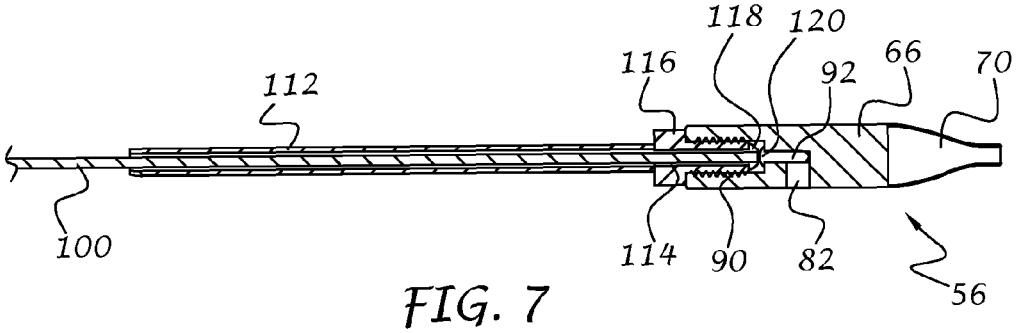
FIG. 7 is a section view of the pin assembly taken along line 7-7 of FIG. 5.
Figure 8:
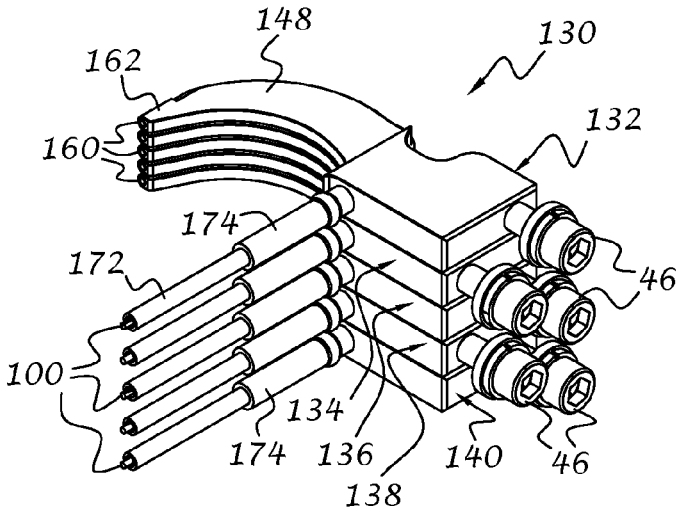
FIG. 8 is a right rear isometric view of a sight assembly with a plurality of pin assemblies in accordance with a further embodiment of the present invention.
Figure 10:
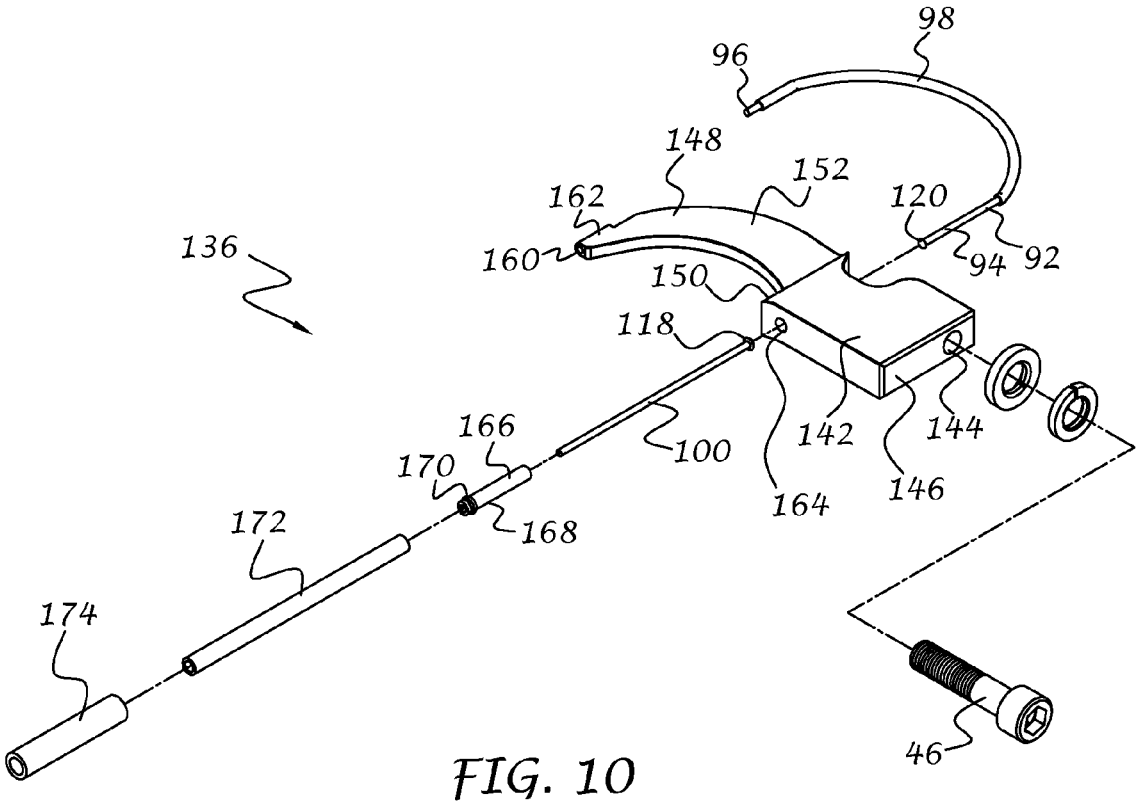
FIG. 10 is a right rear isometric exploded view of one of the pin assemblies of FIG. 8.

With particular reference to FIGS. 4 and 7, the light collector 100 preferably extends through a reinforcing tube 112 and through the bore 114 of a retaining member 116. Preferably, the retaining member 116 comprises a threaded bolt that is in turn threaded into the bore 90 and is adapted to retain the light collector 100 within the bore 90 so that the light collector is optically coupled with the first optical fiber 92. An integral lens 118 is preferably formed at the distal end 102 of the light collector 100 and has a diameter or cross dimension that is larger than the diameter or cross dimension of the light collector 100 and the bore 114 of the retaining member 116. In this manner, the end 102 of the light collector 100 is anchored in the bore 90 by the retaining member 116 while light exiting the distal end is distributed over a wider field of view for coupling with the proximal end 94 of the first optical fiber 92. Likewise, the proximal end 94 of the first optical fiber 92 is also formed with an integral lens 120 that is larger than the diameter or cross dimension of the first optical fiber for efficient light coupling. Enlargement of the ends 118, 120 can be accomplished by applying heat thereto, molding, or other known forming techniques. It will be understood that other means for coupling the light collector with the first optical fiber can be used without departing from the spirit and scope of the present invention.

In use, light incident on the portions of the light collectors 100 is absorbed in the fluorescent-doped optical fibers and is re-emitted at their proximal and distal ends. Light emitted from the distal end 102 is coupled to the proximal end 94 of the clear optical fiber 92 to thereby illuminate the distal end 96 thereof. As described above, the distal ends 96 of the first optical fibers 92 serve as separate illuminated sight dots or points that are adjusted for different distances to a target for a particular bow and arrow or the like. To that end, two or more of the fluorescent-doped optical fibers preferably have different dopant properties so that the illuminated sight dots project different colors of light. The provision of illuminated sight dots with different colors is especially advantageous since it reduces the confusion that may be associated with two or more closely spaced sight dots of the same color.

When it is desirous to change the sight dot color or when one or more of the light collectors becomes inoperable due to breakage or the like, a tool 122 (FIG. 3) is preferably provided for removing the associated retaining member 116. Once removed, the light collector 100 can be removed and a new light collector of the same or different color can be inserted. The retaining member can then be screwed into the bore 90 without the need to disturb the first optical fiber 92. Preferably, the tool 122 is shaped to fit over and engage the flat surfaces of the retaining member 116 without interference from adjacent light collectors. It will be understood that the retaining member 116 can be removed and secured with any suitable tool and/or by hand without departing from the spirit and scope of the present invention.

As shown in FIG. 2, a light module 124 is preferably connected to the bracket member 12 for illuminating the sides of the light collectors 100 during very low light conditions or whenever brighter sight dots are desired. The light module 124 includes a light generating element, preferably in the form of a single LED (not shown). An incandescent bulb, tritium light, or other artificial light source may alternatively be used. The LED is powered by a battery (not shown) and operably connected to a switch or knob 126 for turning the LED on and off and/or for adjusting the brightness of the artificial light source.

Figure 9:
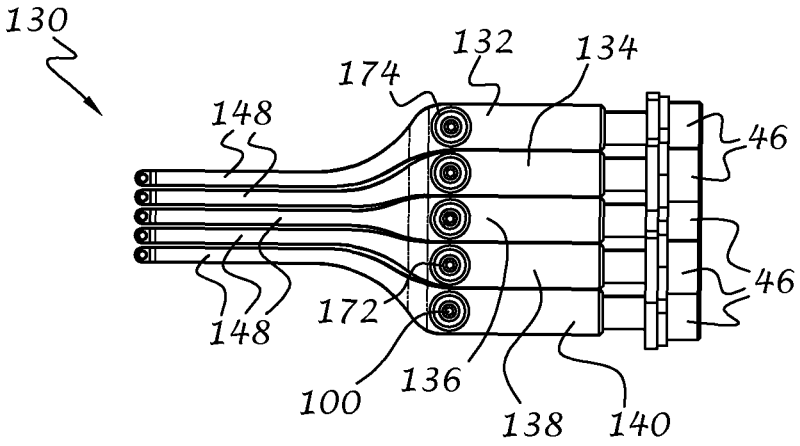
FIG. 9 is a rear elevational view of the sight assembly of FIG. 8.
Figure 11:
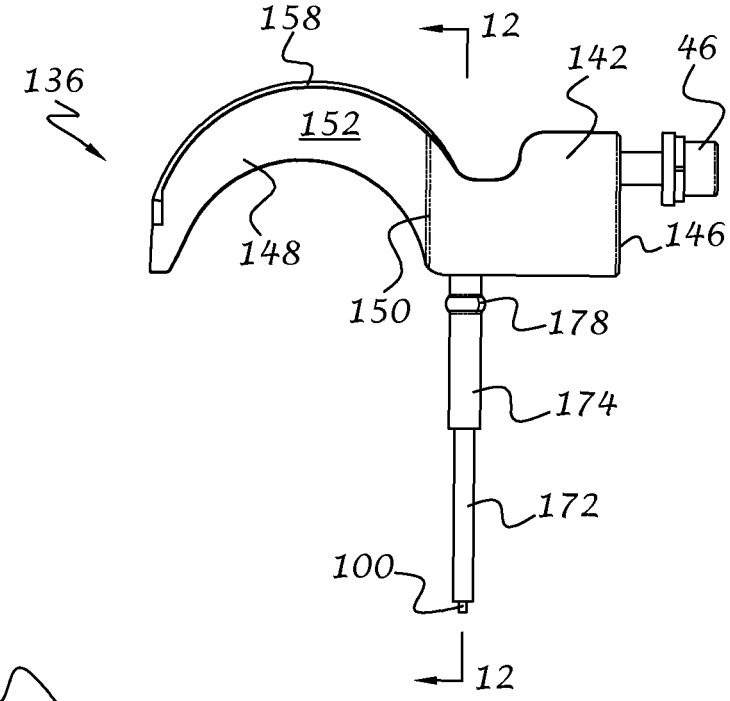
FIG. 11 is a top plan view thereof.

Referring now to FIGS. 8-12, a sight assembly 130 in accordance with a further embodiment of the invention is illustrated. The sight assembly 130 preferably includes a plurality of sight pin assemblies 132, 134, 136, 138 and 140. Although five pin assemblies have been shown, it will be understood that more or less pin assemblies can be used without departing from the spirit and scope of the invention. Each pin assembly preferably has a main body portion 142 with a threaded opening 144 formed in one side 146 thereof for receiving the bolt 46 and an arcuate sight pin portion 148 extending from the opposite side 150 thereof. As shown in FIG. 9, the pin portions of the pin assemblies 132 and 134 curve downwardly before extending horizontally, the pin portions of the pin assemblies 138 and 140 curve upwardly before extending horizontally, and the center pin assembly 136 extends horizontally. In this manner, the pin portions can be located much closer to each other than if they were to extend only in the horizontal direction. However, it will be understood that all of the pin assemblies can be of the same shape or can be configured differently than shown without departing from the spirit and scope of the invention. Since the pin assemblies are otherwise similar in construction with the exception of the alternating bolt hole locations as in the previous embodiment, only the center pin assembly 136 will be described.

The sight pin portion 148 preferably includes an upper surface 152, a lower surface 154 and an arcuate side surface 156 that extends between the upper and lower surfaces. An arcuate slot or groove 158 is formed in the side surface 156 and is sized to receive the first optical fiber 92 with its protective sheath 98. An opening 160 is formed at a convergent tip 162 of the pin portion 148 and intersects with the slot 158. A bore 164 extends into the main body portion 142 and also intersects with the slot 158.

A first optical fiber 92 is preferably located within the slot 158 of the pin portion 148. A proximal end 94 of the optical fiber 92 preferably extends through the bore 164 while a distal end 96 is located in the opening 160. As in the previous embodiment, the optical fiber 92 preferably comprises a plastic optical fiber with a transparent core material and a suitable cladding material having a lower refractive index than the core material to ensure that a substantial amount of radiant energy entering the proximal end 94 will exit the distal end 96.

Figure 12:
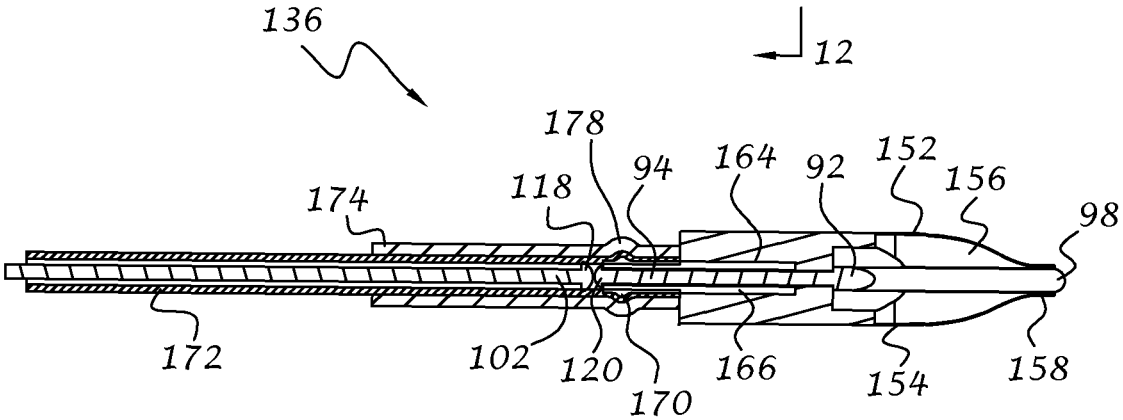
FIG. 12 is a section view of the pin assembly taken along line 12-12 of FIG. 11.
Figure 13:
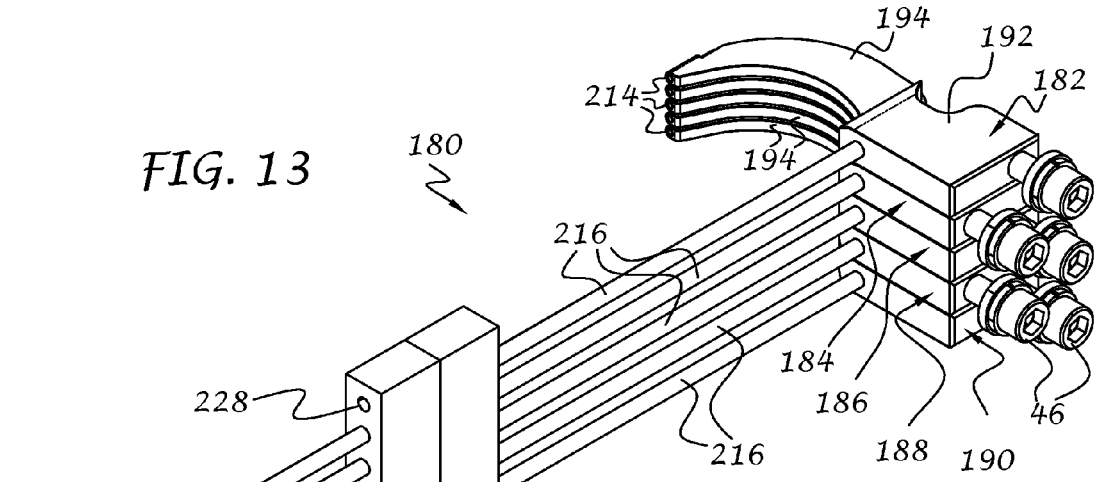
FIG. 13 is a right rear isometric view of a sight assembly with a plurality of pin assemblies in accordance with an even further embodiment of the present invention.
Figure 14:
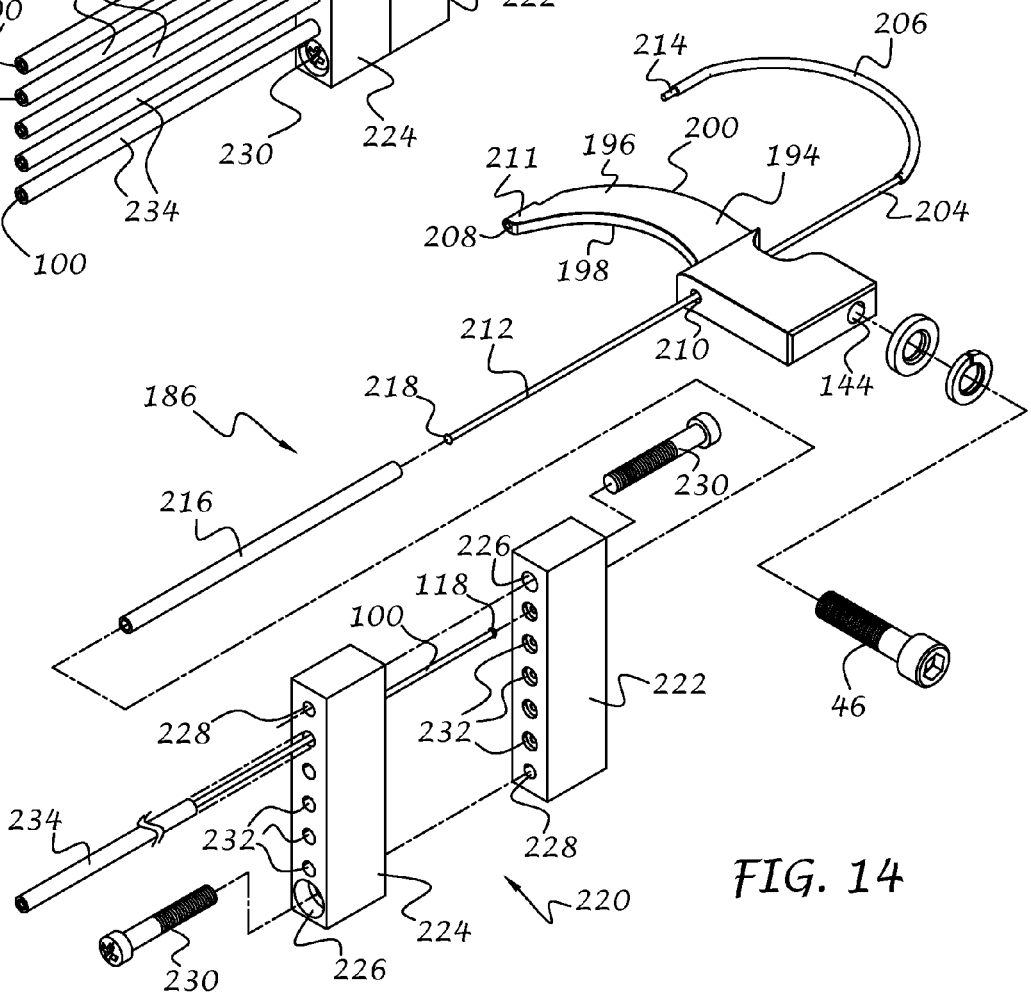
FIG. 14 is a right rear isometric exploded view of one of the pin assemblies of FIG. 13.

A retaining member preferably includes a rigid tubular member 166 that extends into the bore 164 and is attached thereto through any well-known attachment means such as press-fitting, adhesive bonding, welding, and so on. An annular ridge or barb 170 is formed on a proximal end 168 of the tubular member 166. As best shown in FIG. 12, the proximal end 94 of the optical fiber 92 also extends through the tubular member 66 with the lens 120 located rearwardly of the tubular member. The retaining member also preferably includes a resilient tubular member 172 that extends over the rigid tubular member 166 and a reinforcing member 174 that extends over the resilient tubular member 172 to thereby form an annular ridge 178 coincident with the annular barb 170 of the tubular member 166. A light collector 100, as previously described, preferably extends through the tubular member 172. An integral lens 118 is preferably formed at the distal end 102 of the light collector 100 and abuts or is in close proximity to the lens 120 of the first optical fiber 92 to thereby optically couple the two optical fibers together. The retaining member 172 is preferably constructed of a resilient material so that it fits tightly over the barb 170 and restrains the distal end 102 of the light collector 100 from movement and thus inadvertent separation of the light collector from the first optical fiber. The reinforcing member 174 is also preferably constructed of a resilient material.

In use, ambient light is absorbed by the fluorescent-doped optical fibers and is re-emitted at their proximal and distal ends. Light emitted from the distal end 102 is transmitted to the proximal end 94 of the clear optical fiber 92 to thereby illuminate the distal end 96 thereof. As described above, the distal ends 96 of the first optical fibers 92 serve as separate illuminated sight dots or points that are adjusted for different distances to a target for a particular bow and arrow or the like. To that end, two or more of the fluorescent-doped optical fibers preferably have different dopant properties so that the illuminated sight dots project different colors of light.

When it is desirous to change the sight dot color or when one or more of the light collectors becomes inoperable due to breakage or the like, the reinforcing member 174 and retaining member 172 can be pulled by hand until they are free of the barb 170. Once removed, the light collector 100 can be removed and a new light collector of the same or different color can be inserted. The retaining member 172 and reinforcing member 174 can then be pushed back over the barb 170 without the need to disturb the first optical fiber 92. It will be understood that the reinforcing member can be eliminated without departing from the spirit and scope of the present invention.

Figure 15:
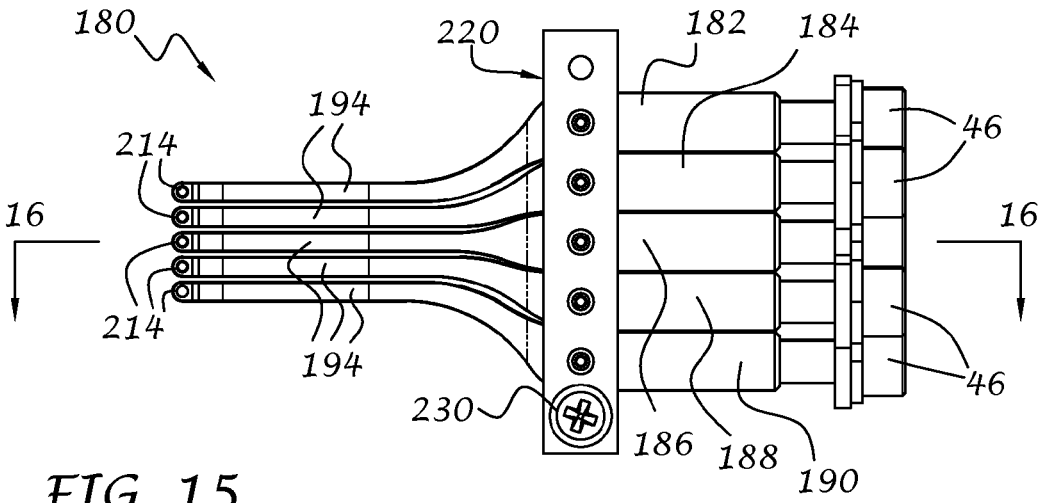
FIG. 15 is a rear elevational view of the sight assembly of FIG. 13.

Referring now to FIGS. 13-16, a sight assembly 180 in accordance with a further embodiment of the invention is illustrated. The sight assembly 180 preferably includes a plurality of sight pin assemblies 182, 184, 186, 188 and 190. Although five pin assemblies have been shown, it will be understood that more or less pin assemblies can be used without departing from the spirit and scope of the invention. Each pin assembly preferably has a main body portion 192 and an arcuate sight pin portion 194 extending from one side thereof as in the previous embodiment. As shown in FIG. 15, the pin portions 194 of the pin assemblies 182 and 184 curve downwardly before extending horizontally, the pin portions of the pin assemblies 188 and 190 curve upwardly before extending horizontally, and the center pin assembly 186 extends horizontally, as in the previous embodiment. However, it will be understood that all of the pin assemblies can be of the same shape or can be configured differently than shown without departing from the spirit and scope of the invention. Since the pin assemblies are otherwise similar in construction with the exception of the alternating bolt hole locations as in the previous embodiment, only the center pin assembly 186 will be described.

The sight pin portion 194 preferably includes an upper surface 196, a lower surface 198 and an arcuate side surface 200 that extends between the upper and lower surfaces. An arcuate slot or groove 202 (FIG. 16) is formed in the side surface 200 and is sized to receive a first optical fiber 204 with its protective sheath 206. It will be understood that the protective sheath 206 can be eliminated without departing from the spirit and scope of the present invention. An opening 208 is formed at a convergent tip 211 of the pin portion 194 and intersects with the slot 202. A bore 210 extends into the main body portion 192 and also intersects with the slot 202.

The first optical fiber 204 is preferably located within the slot 202 of the pin portion 194 with a proximal end 212 extending out of the bore 210 and a distal end 214 located in the opening 208. As in the previous embodiment, the optical fiber 204 preferably comprises a plastic optical fiber with a transparent core material and a suitable cladding material having a lower refractive index than the core material to ensure that a substantial amount of radiant energy entering the proximal end 212 will exit the distal end 214.

Figure 16:
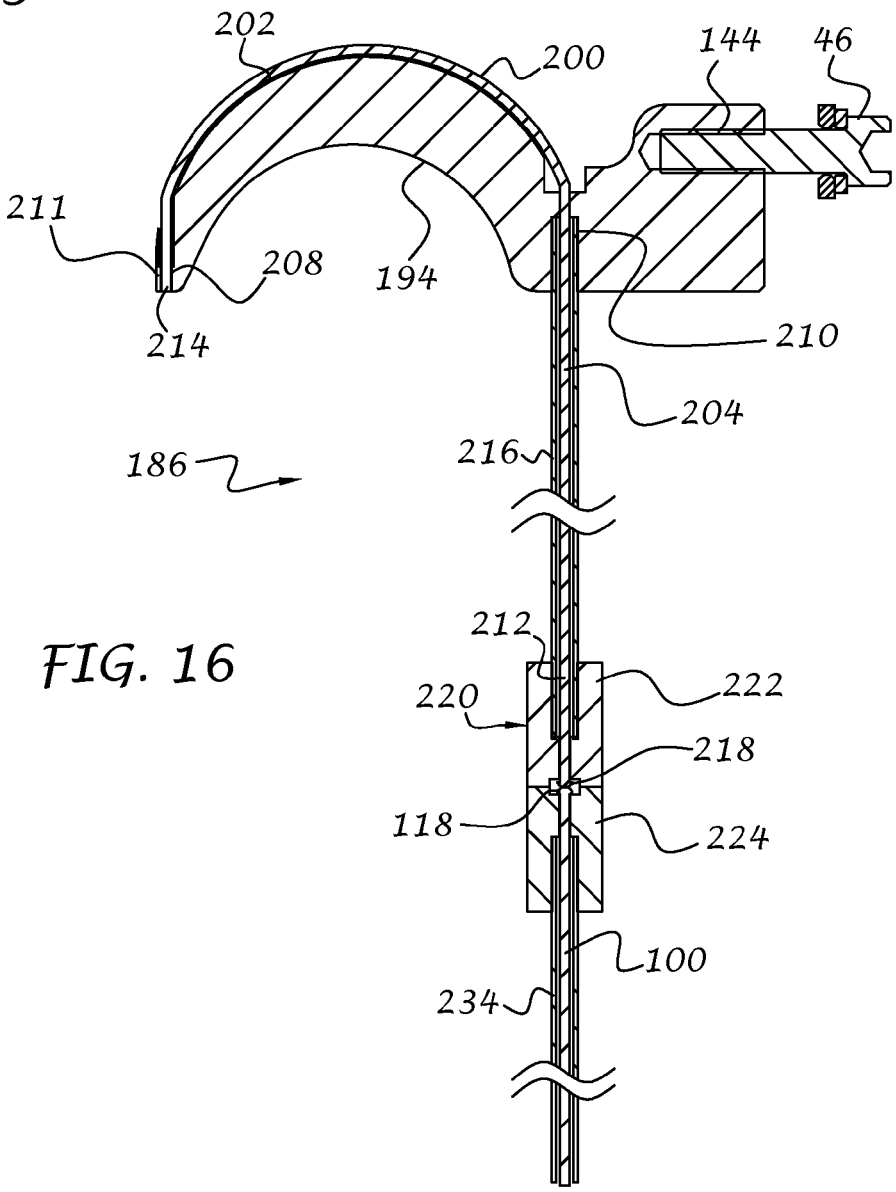
FIG. 16 is a sectional view of one of the pin assemblies taken along line 16-16 of FIG. 15.
Figure 17:
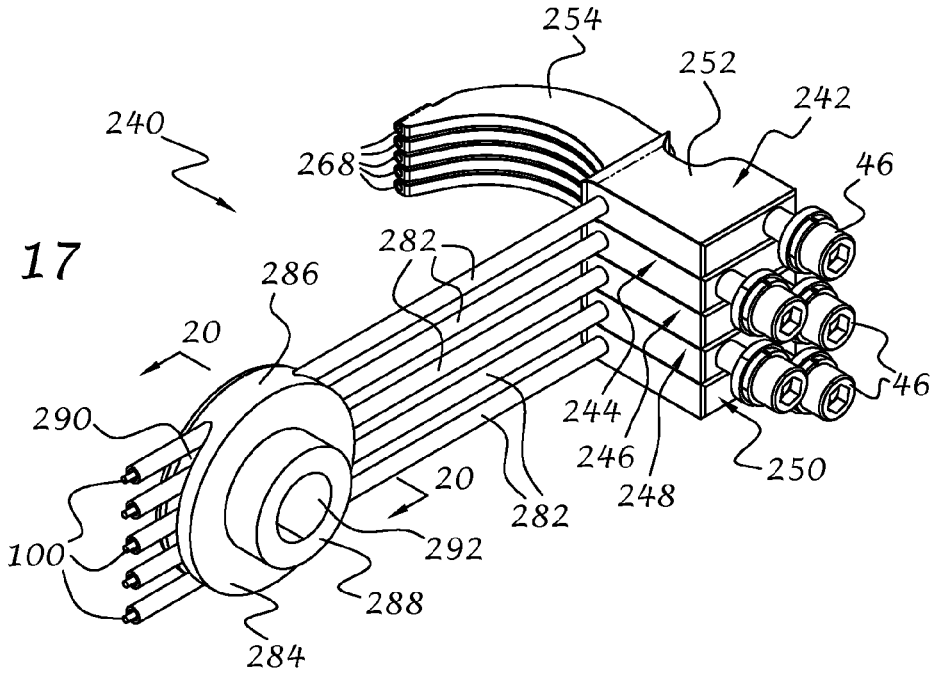
FIG. 17 is a right rear isometric view of a sight assembly with a plurality of pin assemblies in accordance with another embodiment of the present invention.
Figure 18:
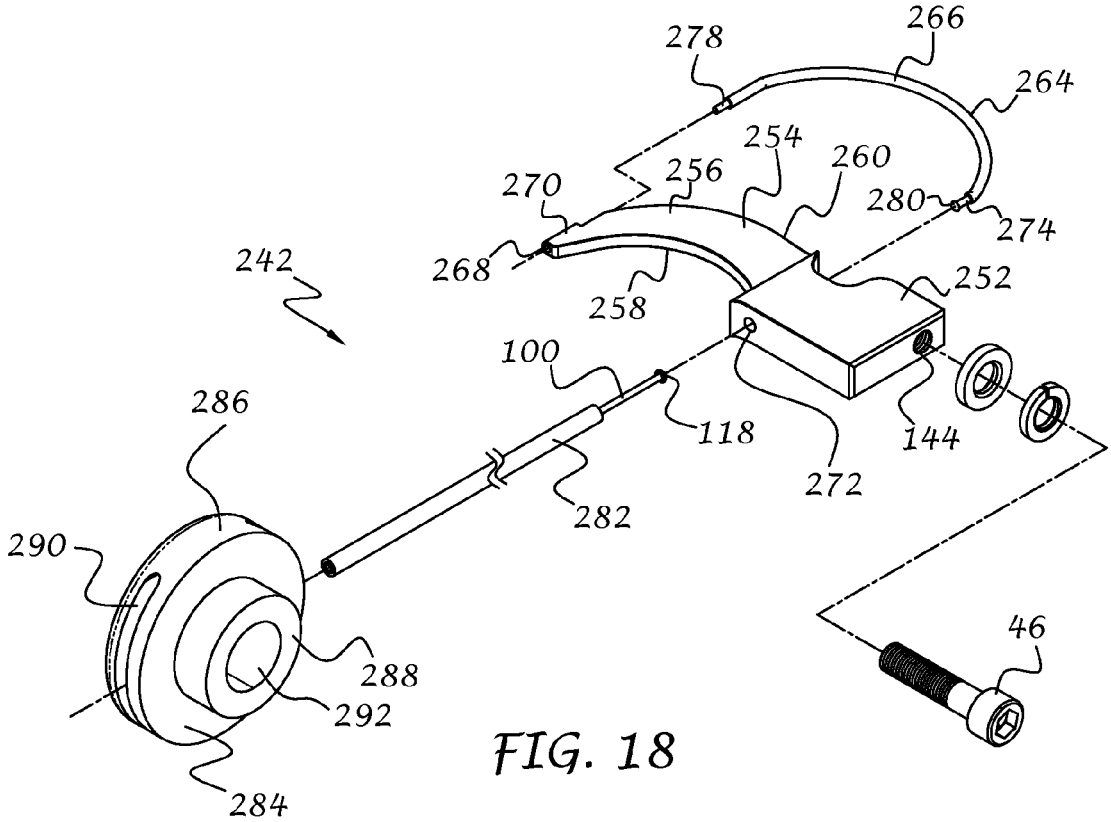
FIG. 18 is a right rear isometric exploded view of one of the pin assemblies of FIG. 17.

A first tubular member 216 extends into the bore 210 and is attached thereto through any well-known attachment means such as press-fitting, adhesive bonding, welding, and so on. As best shown in FIG. 16, the proximal end 212 of the optical fiber 204 also extends through the tubular member 216 with an integrally formed lens 218 located rearwardly of the tubular member. The tubular member 216 can be constructed of a transparent or opaque material.

A retaining member 220 includes a first retaining portion 222 and a second retaining portion 224 that connects with the first retaining portion, preferably via threaded fasteners 230 that extend through a first opening 226 formed in one retaining portion and thread into a second opening 228 formed in the other retaining portion. Countersunk holes 232 are formed in each retaining portion 222 and 224. One or more of the tubular members 216 are preferably press-fit into the holes 232 of the retaining portion 222 with the proximal end 212 of a corresponding number of first optical fibers 204 extending through one of the holes such that the lens 218 is located within the countersunk portion, as shown in FIG. 16. A light collector 100, as previously described, preferably extends through the retaining portion 224 with the integral lens 118 located within the countersunk portion such that the lens 218 and lens 118 abut or are in close proximity to each other to optically couple the first optical fiber 204 with the second optical fiber 100. One or more second tubular members 234 are preferably press-fit into the holes 232 of the retaining portion 224. However, it will be understood that the first and second tubular members can be connected to the retaining portions through other well-known connection means without departing from the spirit and scope of the invention. Each tubular member 234 is sufficiently transparent so that light within the desired wavelength or band of wavelengths is incident on the light collector to thereby illuminate the light collector ends, as previously described.

The retaining member 220 is preferably constructed of a rigid material and can be connected to the bracket member 12 (FIG. 1) or other portion of the sighting device 10, or can be connected only to the first and second optical fibers without any support from the bracket member 12. In use, when it is desirous to install and/or replace one of the light collectors 100, the threaded fasteners 230 are removed and the first and second retaining portions are separated to expose the distal end of the light collector 100 and the proximal end of the first optical fiber. The light collector can be removed by pulling at its distal end and a new light collector can be installed in its place by snaking the proximal end of the light collector through the holes 232 until the lens 118 is within the countersunk portion. The retaining portions are then brought together and the fasteners 230 are inserted to secure the retaining portions together.

Although the retaining member 220 is capable of incorporating all fiber connections into a single unit in a linear array as shown, it will be understood that other configurations are contemplated without departing from the spirit and scope of the invention. For example, the retaining member 220 can be embodied as a polar array, asymmetric linear or polar arrays, and so on. In addition, the retaining member 220 can be modified so that it only receives the ends of one pair of optical fibers so that a plurality of retaining members equal to the number of pin sight assemblies are used. The retaining member can be stand-alone as shown or integrated into another part of the sighting device 10, such as the aperture, bracket and so on. In addition, although the retaining member is shown as being held together by threaded fasteners, such as screws, it can alternatively be connected together by snap tabs, rubber O-rings, press fit, cam lock, cooperating threads, magnets, or any other connecting means. Moreover, although not shown, the retaining member can be keyed so that it fits together only one way, or it may not be keyed so that the retaining portions can be flipped over for accommodating a left-handed archer. The retaining member can also be provided in multiple sets with different color schemes for the light collectors so that the user can readily select a new set of colors for the sight pin assemblies without the necessity of removing and recalibrating each sight pin assembly.

Figure 19:
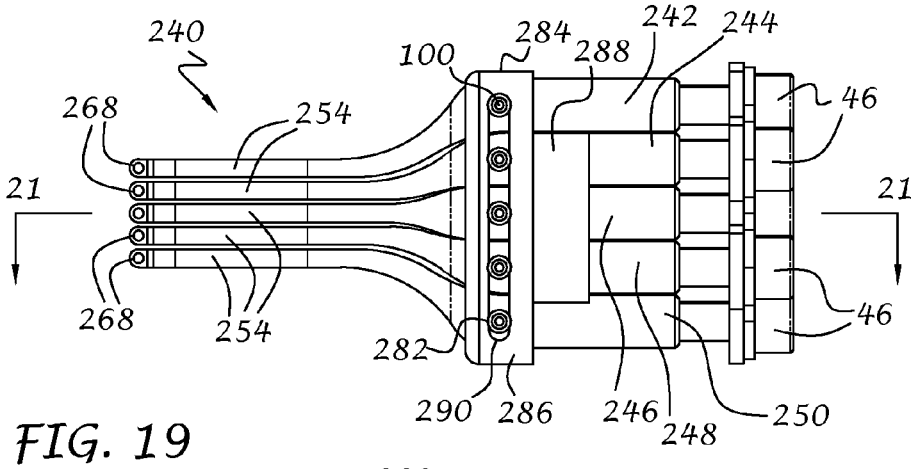
FIG. 19 is a rear elevational view of the sight assembly of FIG. 17.
Figure 20:
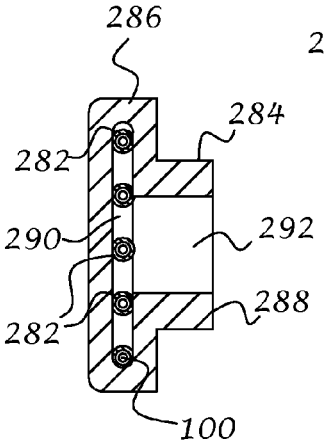
FIG. 20 is a sectional view of the sight assembly taken along line 20-20 of FIG. 17.
Figure 21:
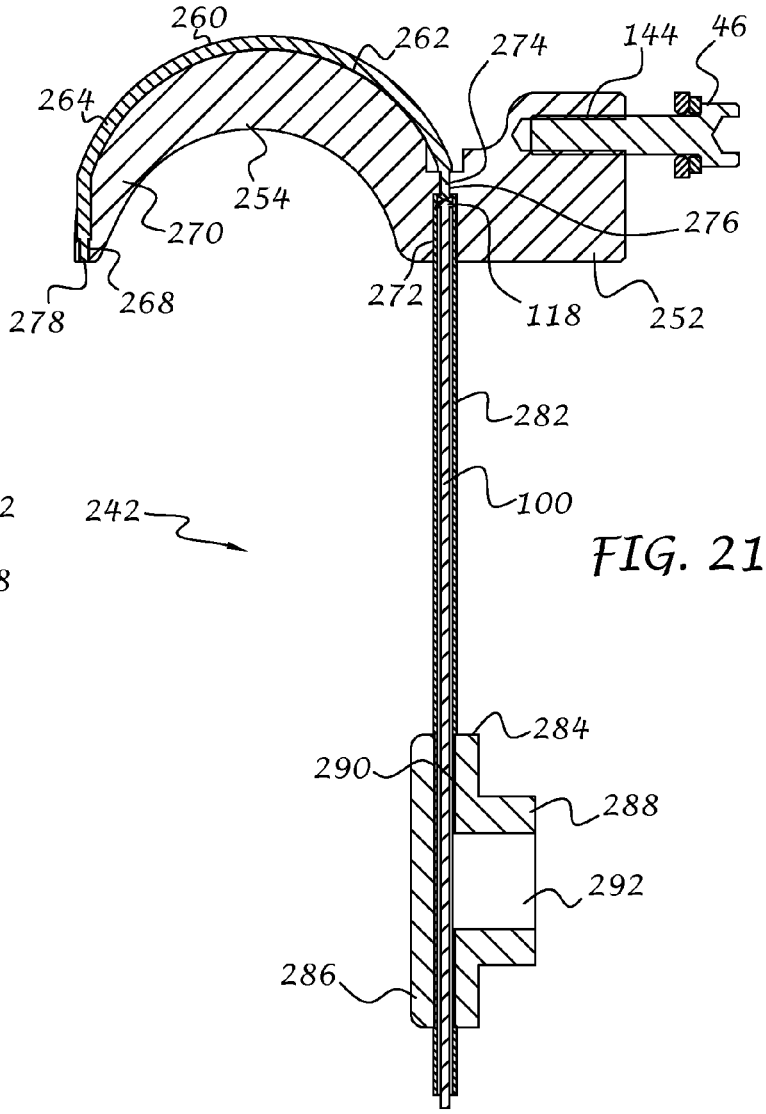
FIG. 21 is a section view of one of the pin assemblies taken along line 21-21 of FIG. 19.
Figure 22:
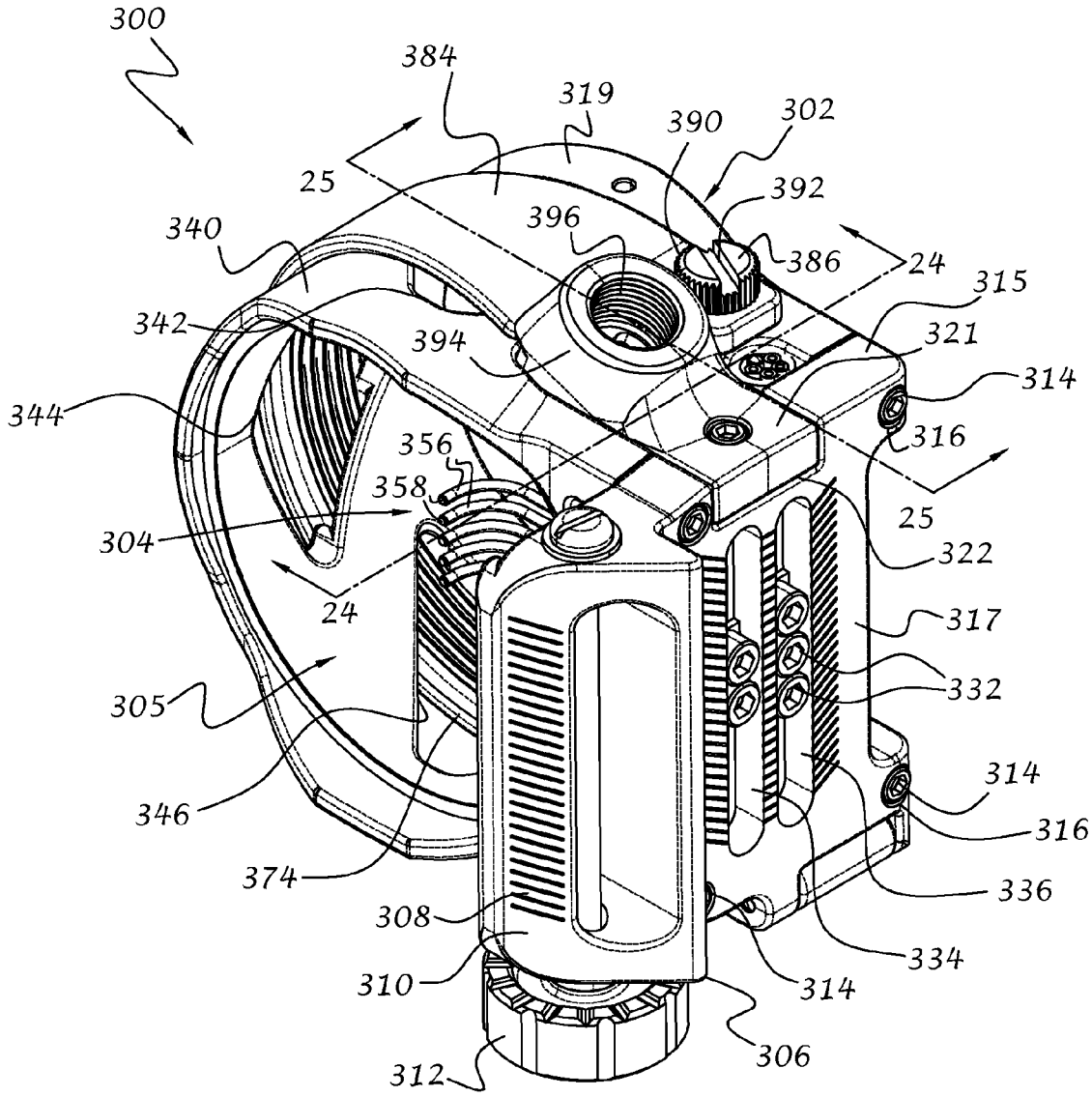

Referring now to FIGS. 17-21, a sight assembly 240 in accordance with a further embodiment of the invention is illustrated. The sight assembly 240 preferably includes a plurality of sight pin assemblies 242, 244, 246, 248 and 250. Although five pin assemblies have been shown, it will be understood that more or less pin assemblies can be used without departing from the spirit and scope of the invention. Each pin assembly preferably has a main body portion 252 and an arcuate sight pin portion 254 extending from one side thereof as in the previous embodiment. As shown in FIG. 19, the pin portions 254 of the pin assemblies 242 and 244 curve downwardly before extending horizontally, the pin portions of the pin assemblies 248 and 250 curve upwardly before extending horizontally, and the center pin assembly 246 extends horizontally, as in the previous embodiment. However, it will be understood that all of the pin assemblies can be of the same shape or can be configured differently than shown without departing from the spirit and scope of the invention. Since the pin assemblies are otherwise similar in construction with the exception of the alternating bolt hole locations as in the previous embodiment, only the center pin assembly 246 will be described.

The sight pin portion 254 preferably includes an upper surface 256, a lower surface 258 and an arcuate side surface 260 that extends between the upper and lower surfaces. A continuous arcuate slot or groove 262 (FIG. 21) is formed in the side surface 260 and is sized to receive a first optical fiber 264 with its protective sheath 266. It will be understood that the protective sheath 266 can be eliminated without departing from the spirit and scope of the invention. An opening 268 is formed at a convergent tip 270 of the pin portion 254 and intersects with the slot 262. A bore 272 extends into the main body portion 252 and also intersects with the slot 262.

The first optical fiber 204 is preferably located within the slot 262 of the pin portion 254 with a proximal end 274 located within a reduced diameter portion 276 of the bore 272 and a distal end 278 located in the opening 268. As in the previous embodiment, the optical fiber 264 preferably comprises a plastic optical fiber with a transparent core material and a suitable cladding material having a lower refractive index than the core material to ensure that a substantial amount of radiant energy entering the proximal end 274 will exit the distal end 278. The proximal end 274 preferably has an integrally formed lens 280 that fits within the larger diameter portion of the bore 272 to anchor the first optical fiber 204 to the main body portion 252.

A tubular member 282 preferably extends into the bore 272 and is attached thereto through any well-known attachment means such as press-fitting, adhesive bonding, welding, and so on. The tubular member 282 can be constructed of a transparent or opaque material.

A retaining member 284 preferably includes a disk-shaped body portion 286 and an annular connection portion 288 that extends from the body portion 286. An elongate slot 290 extends through the body portion 286 and is dimensioned to receive one or more of the tubular members 282 in a friction-type fit so that the tubular members are held against movement. Accordingly, one or more of the tubular members 282 can be removably press-fit into the elongate slot 290 of the retaining member 284. An opening 292 is formed in the annular connection portion 288 that can receive a light module, such as light module 124 in FIG. 2, for artificially illuminating the light collectors 100 in the event of low ambient light conditions or when a brighter sight dot is desired.

A light collector 100, or second optical fiber, as previously described, preferably extends through the tubular member 282 with the integral lens 118 located within the larger diameter portion of the bore 272 such that the lens 280 and lens 118 abut or are in close proximity to each other to optically couple the first optical fiber 264 with the second optical fiber 100. It will be understood that one or more of the tubular members 282 can be connected to the retaining member 284 through other well-known connection means without departing from the spirit and scope of the invention. Each tubular member 282 is sufficiently transparent so that light within the desired wavelength or band of wavelengths is incident on the light collector to thereby illuminate the light collector ends, as previously described.

The retaining member 284 is preferably constructed of a rigid material and can be connected to the bracket member 12 (FIG. 1) via the connection portion 288 or other portion of the sighting device 10, or can be connected only to the first and second optical fibers without any support from the bracket member 12. The connection portion 288 can have internal threads for engagement with a threaded fastener or the like. However, it will be understood that the connection portion 288 can be configured to connect to the bracket member or other sight portion through any well known connection means or can be eliminated completely without departing from the spirit and scope of the invention. With the above-described arrangement, compression against the face of the pin can be adjusted, thereby securing the optical coupling inside the pin.

In use, when it is desirous to install and/or replace one of the light collectors 100, the retaining member 284 is removed from the bracket member (or other sight component) if attached, and one or more of the tubular members 282 are removed from the retaining member by pulling on the retaining member and/or tubular member so that the tubular member is separated from the retaining member. The light collector can then be removed from the tubular member and replaced with another light collector of the same or different color by snaking the light collector through the tubular member.

Referring now to FIGS. 22-25, a sight assembly 300 in accordance with a further embodiment of the invention is illustrated. The sight assembly 300 preferably includes a frame portion 302 and a sight portion 304 extending from the frame portion into a sight window 305. The frame portion 302 is adapted for connection to an adjustment base, such as base 14 in FIG. 1 or other suitable component, via a dovetail-like projection 306. A height scale 308 (FIG. 22) can be provided on a vertical surface 310 of the dovetail-like projection 306 for displaying the relative position between the sight assembly 16 and the adjustment base or other component. Vertical adjustment of the entire sight assembly 300 may be needed when initially calibrating the sighting device with a particular bow or other device, when changing from one arrow type to another, when shooting from different heights, such as from the ground or a tree stand, and so on, and thus can be provided with an adjustment knob 312 for vertically moving the sight assembly 300 with respect to the bracket member or other sight component (not shown) when connected thereto in a well-known manner.

The frame portion 302 preferably includes a base section 315 connected to a sight frame section 319 with bolts 314 (FIG. 22) that extend through openings 316 formed in a side wall 317 of the base section and into threaded openings 318 (FIG. 24) formed in a mating vertical wall 320 of the sight frame section 319. A retaining member 321 is secured in a slot 322 formed in the vertical wall 317 of the base section 315 via a bolt 324 that extends through a countersunk opening 326 in the retaining member 321 and into a threaded opening 328 (FIG. 25) formed in the vertical wall 317. It will be understood that other means for connecting the sections of the frame portion together can be used without departing from the spirit and scope of the invention. Moreover, although the frame portion 302, base section 315, and sight frame section 319 are shown as separate components, it will be understood that they can be machined or molded as a single, integral unit without departing from the spirit and scope of the invention.

The sight portion 304 preferably includes one or more sight pin assemblies 330 connected to the frame portion 302 with bolts 332 (FIG. 22) that extend through vertically extending slots 334, 336 formed in the side wall 317 of the base section 315 and into threaded openings 338 (FIG. 24) of each alternating pin assembly 330. In this manner, each pin assembly 330 is independently adjustable in a vertical direction to accommodate a particular bow strength and/or arrow type for different yardages or distances to a target.

The sight frame section 319 preferably has an annular wall 340 that forms the sight window 305 through which the sight pin assemblies 330 and a distal target can be viewed. Preferably, the sight pin assemblies 330 are mounted to the frame portion 302 within the sight window 305. Openings 342, 344, and 346 (FIGS. 22 and 25) can be provided in the annular wall 340 to reduce the weight of the sight assembly 300 and provide more light for the sight portion 304.

As in the previous embodiments, the sight pin assemblies 330 are vertically oriented to demark different target distances. Although five separate pin assemblies 330 are shown, it will be understood that more or less pin assemblies may be provided. Since the pin assemblies 330 are substantially identical in construction, only one of the pin assemblies 330 will be described in greater detail.

Figure 23:
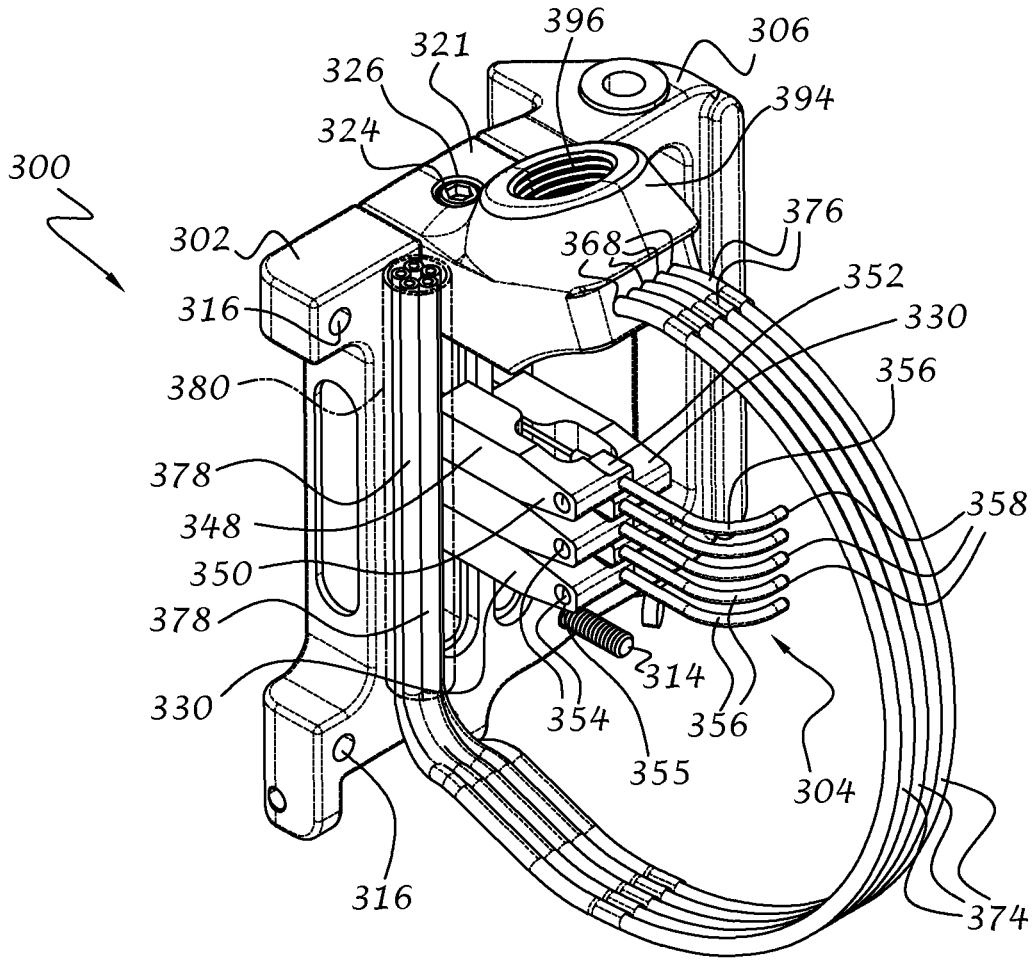
FIG. 23 is a left front isometric view of the illuminated sight assembly of FIG. 22 with components removed to show the arrangement of the light collectors that form part of the illuminated sighting device.
Figure 24:
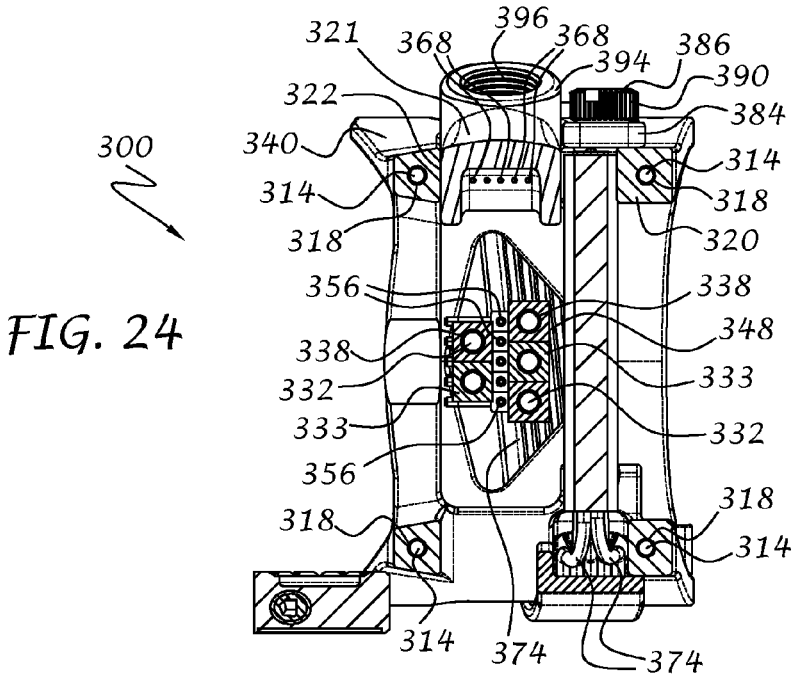
FIG. 24 is a sectional view of the illuminated sight assembly taken along line 24-24 of FIG. 22.
Figure 25:
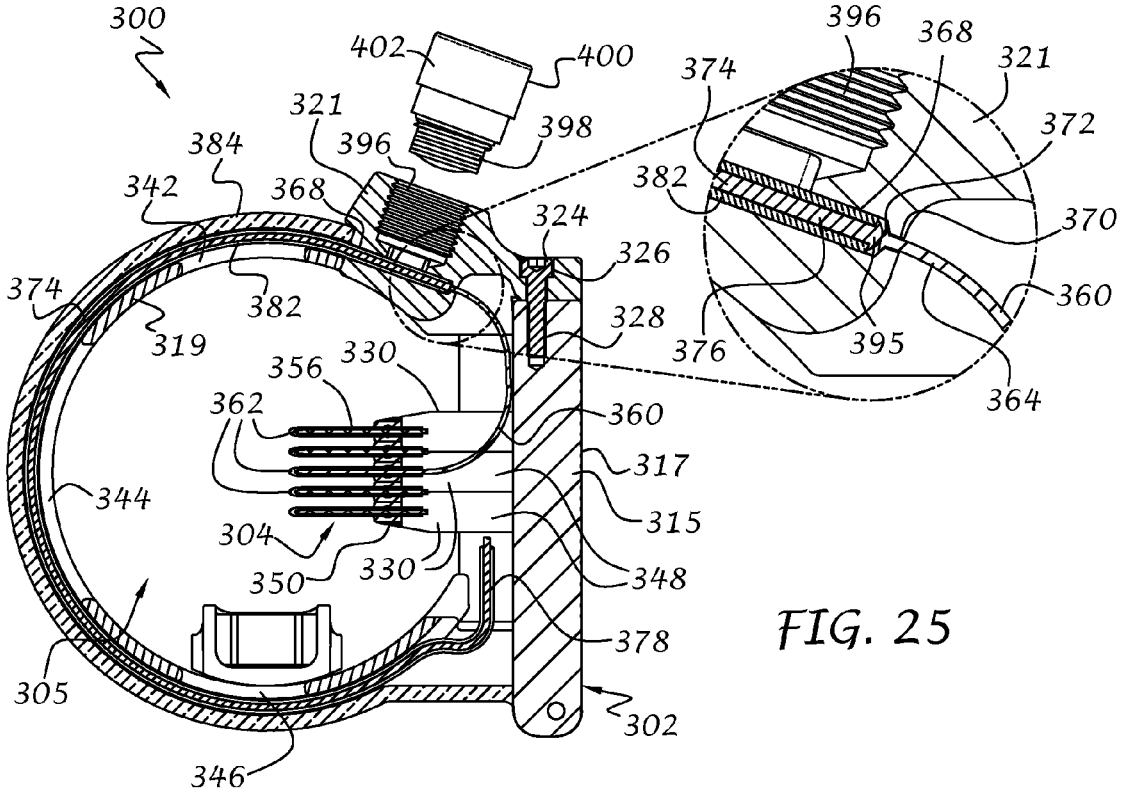
FIG. 25 is a sectional view of the illuminated sight assembly taken along line 25-25 of FIG. 22 with a portion of the retaining member enlarged to show additional details.

With particular reference to FIGS. 23 and 25, the sight pin assembly 330 preferably includes a main body portion 348 with the threaded opening 338 (FIG. 24) formed in one side thereof and a clamping portion 350 located at the opposite side thereof. The clamping portion includes a jaw 352 and a threaded fastener 354 that extends through an opening 355 formed in the main body portion 348 and threads into the main body portion. Rotation of the fastener causes the fastener to move with respect to the main body portion 348 for releasably clamping a pin portion 356 against the jaw. The pin portion 356 is preferably in the form of a hollow, rigid tube or protective sheath that is gently curved at approximately 90 degrees so that the outer distal end 358 of the tube faces a user during aiming.

A first optical fiber 360 is preferably located within the pin portion 356. A distal end 362 of the first optical fiber 360 terminates at the distal end 358 of the pin portion 356 to thereby create an illuminated sight dot viewable by the user when aiming. A proximal end 364 of the optical fiber 360 is located in a bore 368 (see also FIG. 24) formed in the retaining member 321. The bore 368 has a reduced portion 370 that closely matches the diameter or cross dimension of the first optical fiber 360 so that an integral lens 372 formed at the proximal end 364 of first optical fiber has a diameter or cross dimension that is larger than the diameter or cross dimension of the reduced portion 370 of the retaining member 321. In this manner, the end 364 of the optical fiber 360 is anchored in the bore 368 of the retaining member 321.

As in the previous embodiments, the optical fiber 360 preferably comprises a plastic optical fiber with a transparent core material and a suitable cladding material having a lower refractive index than the core material to ensure that a substantial amount of radiant energy entering the proximal end 364 will exit the distal end 362. However, it will be understood that any suitable material can be used for the optical fiber without departing from the spirit and scope of the invention. The distal end 362 of the optical fiber 360 serves as an illuminated sight point or dot during aiming. If desired, one or both ends of the first optical fiber 360 can be formed with a lens. Whether or not the distal end 362 of the optical fiber 360 is formed with a lens, the internal diameter of the pin portion 356 is preferably slightly larger than the diameter or cross dimension of the optical fiber 360 so that the optical fiber can be quickly and easily removed from the pin portion 356 when it is desirous to replace the optical fiber in the event of a breakage or other condition.

As best shown in FIGS. 23 and 25, a plurality of light collectors 374, or second optical fibers, are preferably provided. Each light collector 374 preferably extends through a transparent protective tube or sheath 382. Each light collector 374 has a distal end 376 that extends into the bore 368 of the retaining member 321 for optical connection with the proximal end 364 of the optical fiber 360. Each light collector 374 preferably includes a single length of fluorescent-doped optical fiber that extends from the retaining member 321, around the annular wall 340 of the sight frame section 319, and terminates at a proximal or outer free end 378, preferably within a vertically oriented transparent tube 380. A transparent cover 384 preferably extends around the annular wall 340 for protecting the light collectors 374. The cover 384 is removably connected to the sight frame section 319 via a fastener 386 that extends through the cover and threads into an opening (not shown) in the sight frame section. The fastener 386 has a knurled surface 390 for grasping by the thumb and finger of a user to install and remove the fastener by hand. A slot 392 is also formed in the fastener for insertion of a screwdriver or other suitable tool when hand removal may be too difficult for some users. The removable nature of the transparent cover 384 permits the quick removal and installation of one or more light collectors when damaged or when the user desires to customize the color of the light output, thus enabling the use of multiple colored light collectors.

An integral lens 395 is preferably formed at the distal end 376 of the light collector 374 and has a diameter or cross dimension that is larger than the diameter or cross dimension of the light collector 374 and the reduced portion 370 of the bore 368 of the retaining member 321. In this manner, light exiting the distal end 376 is distributed over a wider field of view for coupling with the proximal end 364 of the first optical fiber 360. Enlargement of the ends 376, 364 can be accomplished by applying heat thereto, molding, or other known forming techniques. It will be understood that other means for coupling the light collector with the first optical fiber can be used without departing from the spirit and scope of the present invention.

The retaining member 321 preferably includes a plurality of the bores 368 for receiving the light collectors 374. The retaining member also preferably includes a conical projection 394 with a threaded opening 396 for receiving the threaded portion 398 of a light module 400 (FIG. 25) for illuminating the sides of the light collectors 374 during very low light conditions or whenever brighter sight dots are desired. The light module 400 includes a light generating element, preferably in the form of a single LED (not shown). An incandescent bulb, tritium light, or other artificial light source may alternatively be used. The LED is powered by a battery (not shown) and operably connected to a switch or knob 402 for turning the LED on and off and/or for adjusting the brightness of the artificial light source.

In use, ambient light and/or artificial light incident on the light collectors is absorbed in the fluorescent-doped optical fibers and is re-emitted at their proximal and distal ends. Light emitted from the distal end 376 is coupled to the proximal end 364 of the clear optical fiber 360 to thereby illuminate the distal end 362 thereof. As described above, the distal ends 362 of the first optical fibers 360 serve as separate illuminated sight dots or points that are adjusted for different distances to a target for a particular bow and arrow or the like. To that end, two or more of the fluorescent-doped optical fibers preferably have different dopant properties so that the illuminated sight dots project different colors of light. The provision of illuminated sight dots with different colors is especially advantageous since it reduces the confusion that may be associated with two or more closely spaced sight dots of the same color.

When it is desirous to change the sight dot color or when one or more of the light collectors becomes inoperable due to breakage or the like, the transparent cover can be removed, as described above, and one or more of the light collectors 374 can be removed and replaced with one or more new light collectors of the same or different colors. The cover 384 can then be installed without the need to disturb the first optical fibers 360. Since the first optical fibers 360 remain undisturbed, there is no need to recalibrate the sight assembly 300, thus saving time and effort when changing out one or more of the light collectors.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. An illuminated sight assembly comprising:

a sight pin having a first bore;

at least one first optical fiber operably associated with the sight pin, the first optical fiber having a distal end forming an illuminated sight dot and a proximal end spaced from the distal end with a first enlarged diameter portion located in the first bore;

at least one light collector comprising a fluorescent doped optical fiber with proximal and distal ends, the optical fiber being configured to receive radiant energy along its length and direct the radiant energy to the proximal and distal ends, the distal end being optically coupled to the proximal end of the at least one first optical fiber such that radiant energy is transmitted from the at least one light collector to the distal end of the first optical fiber to thereby form the illuminated sight dot; and a retaining member removably connected to the sight pin and extending into the first bore, the retaining member having a second bore coaxial with the first bore for receiving the light collector for removably connecting the distal end of the light collector to the proximal end of the first optical fiber such that the light collector can be removed and installed independently of the first optical fiber by removing the retaining member from the first bore, the distal end of the light collector having a second enlarged diameter portion located in the first bore and facing the first enlarged diameter portion for optically coupling the at least one first optical fiber with the at least one light collector, with the first and second enlarged diameter portions being greater than a cross dimension of each of the first and second bores such that the first optical fiber and the light collector are retained in the sight pin when the retaining member is connected to the sight pin;

wherein removal of the retaining member from the sight pin allows the light collector to be removed from the retaining member and replaced with another light collector.

2. An illuminated sight assembly according to claim 1, wherein the sight pin comprises:

a main body portion and a pin portion extending from the main body portion;

a continuous slot extending through the main body portion and the pin portion; and an opening located at a distal end of the pin portion;

wherein the at least one first optical fiber is positioned in the continuous slot such that the distal end of the first optical fiber is coincident with the opening to thereby contain the illuminated sight dot.

3. An illuminated sight assembly according to claim 2, wherein the first bore is formed in the main body portion, the first bore being coaxial with a proximal end of the continuous slot.

4. An illuminated sight assembly according to claim 3, wherein the retaining member comprises a threaded fastener and the first bore of the main body portion comprises internal threads for engaging the threaded fastener for removably connecting the retaining member to the main body portion.

5. An illuminated sight assembly according to claim 4, wherein the distal end of the second optical fiber has a lens with a cross dimension that is larger than the cross dimension of the second bore of the fastener to thereby retain the second optical fiber in the retaining member.

6. An illuminated sight assembly according to claim 1, wherein the at least one light collector comprises a plurality of interchangeable light collectors, each light collector having a fluorescent dopant of a different color, such that a color of the illuminated sight dot is changed when one of the interchangeable light collectors is exchanged for another of the interchangeable light collectors.

7. An illuminated sight assembly according to claim 1, and further comprising:

a frame portion forming a sight window with the at least one sight pin extending into the sight window.

* * * * *